United States Patent [19]

Hensel

[11] 4,237,957

[45] Dec. 9, 1980

[54] VENETIAN BLIND AND TAPE ROLL SUPPORT FOR A VENETIAN BLIND

[75] Inventor: Erich E. Hensel, Wassenaar, Netherlands

[73] Assignee: Hunter Douglas International N.V., Netherlands

[21] Appl. No.: 18,258

[22] Filed: Mar. 7, 1979

[30] Foreign Application Priority Data

Dec. 14, 1978 [GB] United Kingdom ..... 48605/78

[51] Int. Cl.[3] ..... E06B 9/38

[52] U.S. Cl. ..... 160/178 R

[58] Field of Search ..... 160/168–178 R, 160/178 C

[56] References Cited

U.S. PATENT DOCUMENTS

| | | | |
|---|---|---|---|
| 2,494,858 | 1/1950 | Burns | 160/173 |
| 2,620,026 | 12/1952 | Rutledge | 160/177 |
| 2,622,673 | 12/1952 | Nelson | 160/173 |
| 2,721,609 | 10/1955 | Rutledge | 160/177 |
| 2,744,572 | 5/1956 | Lorentzen | 160/173 |
| 3,425,479 | 2/1969 | Lorentzen et al. | 160/176 R |

FOREIGN PATENT DOCUMENTS

| | | |
|---|---|---|
| 769385 | of 0000 | United Kingdom . |
| 1009054 | of 0000 | United Kingdom . |
| 1179528 | of 0000 | United Kingdom . |

*Primary Examiner*—Peter M. Caun

*Attorney, Agent, or Firm*—Pennie & Edmonds

[57] ABSTRACT

A venetian blind and a tape roll support for fitting in a venetian blind headrail which is of channel-shaped cross-section, formed of a lower web and front and rear flanges, and having an inturned rim at the upper free edges of the flanges, the support including a base, an inclined wall extending upwardly and forwardly from the base and a rear wall extending upwardly from the base, upper inclined portions at the top of the front and rear walls being engageable by the inturned rim to hold the base in engagement against the lower web. The support can be fitted merely by pushing downwardly into the headrail which is caused to flex and spring back to hold the support in place.

5 Claims, 7 Drawing Figures

VENETIAN BLIND AND TAPE ROLL SUPPORT FOR A VENETIAN BLIND

BACKGROUND OF THE INVENTION

The present invention relates to a tape roll support for fitting in a venetian blind headrail, which is of channel-shaped cross-section, being formed of a lower web and front and rear flanges, and having an inturned rim at the upper free edge of the front and rear flanges. The invention also relates to a venetian blind incorporating tape roll supports.

This form of headrail is extensively used in venetian blinds but the tape roll supports accommodating the tape rolls which are used for supporting the ladder tapes or ladder cords of the venetian blinds are usually quite cumbersome and difficult to fit into such a headrail, if the headrail is of very small dimensions, for example, an inch or an inch and a half wide. In many cases other extra fixing means are used most of which are clearly visible and give the headrail an unsightly appearance.

SUMMARY OF THE INVENTION

It is now proposed, according to the invention, to provide a tape roll support for fitting in a venetian blind headrail of the type referred to above, wherein the tape roll support comprises, in combination:

(a) a base engageable with the upper surfaces of the lower web of the headrail;

(b) an inclined front wall extending upwardly and forwardly from said base;

(c) a rear wall extending upwardly from said base;

(d) an upper portion at the top of said front wall inclined upwardly and rearwardly and engageable by the inturned rim at the upper free edge of the front flange, when the tape roll support is fully engaged in said headrail;

(e) an upper portion at the top of said rear wall inclined upwardly and forwardly and engageable by the inturned rim at the upper free edge of the rear flange, when the tape roll support is fully engaged in said headrail; and (f) side walls connected to said base between which the tape roll is rotatable mountable on a tilt rod.

Such a construction can readily be fitted into the headrail simply by inserting it between the inturned rims and then pushing it firmly downwardly until the base engages the lower web. While the base is being pushed downwardly the front flange of the headrail is caused to flex forwardly by the engagement of its rim on the front wall of the tape roll support. When the latter is fully engaged, the front flange springs back and engages the upper portion of the front wall of the support, which is in the form of an inclined upwardly and rearwardly extending flange. At the same time this forces the rim on the rear flange to engage the upper portion of the rear wall, which in turn is in the form of an upwardly and forwardly extending tab.

In the foregoing description, and in the following claims, the terms "front" and "rear" have been used for convenience. It would, of course, be equally appropriate to mount the tape roll support the other way round, that is to say so that the inclined "front" wall is at the rear of the blind.

In order to make the base firmer and to provide adequate space for the ladder tape or cord, the base may extend forwardly beyond the point at which it is connected to the front wall. The base may also be provided with downwardly extending projections which engage in recesses formed in the lower web of the headrail.

In order that the invention may more readily be understood, the following description is given, merely be way of example, of the presently considered best mode of putting the invention into effect, reference being made to the accompanying drawings.

DETAILED DESCRIPTION OF THE PREFERRED EMBODIMENT

Figure 1:
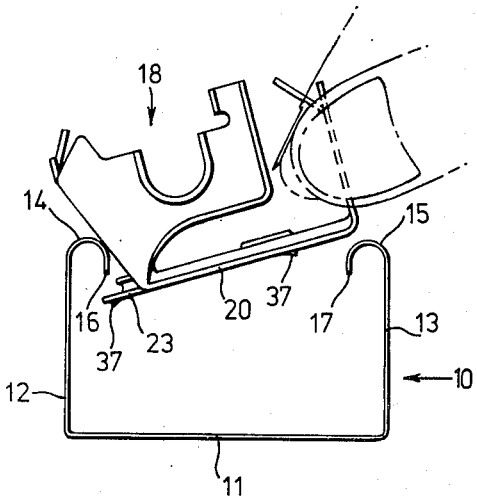
FIGS. 1 to 4 are side elevations of a headrail showing the various stages of positioning one embodiment of tape roll support according to the invention in the headrail, the lower portion being shown in section in FIG. 4.

Referring first to FIGS. 1 to 4 there is illustrated a headrail indicated by the general reference numeral 10 and this is of generally channel-shaped cross-section including a lower web 11 and front and rear flanges 12 and 13. These flanges are provided with inturned rims 14 and 15 at their upper edges, the rims having lowermost tips 16 and 17 respectively.

A tape roll support indicated by the general reference numeral 18 is shown being inserted in the headrail 10.

Figure 5:
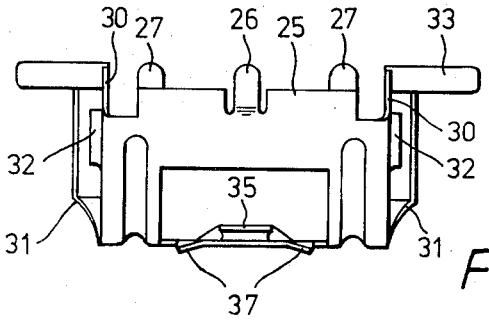
FIG. 5 is a front elevation of the tape roll support shown in FIGS. 1 to 4.

The tape roll support 18 includes a base 20 having an inclined front wall 21 extending upwardly and forwardly from the base 20 and a rear wall 22 extending upwardly from the rear edge of the base 20. It will be seen that the base extends forwardly at 23 beyond the point 24 at which the front wall is connected to the base. At its upper edge, the front wall has a vertically upwardly extending part 25 and an upper portion 26, which is in the form of a tab bent out of the part 25, which extends upwardly and rearwardly from the front wall as can be seen with reference to FIGS. 2 and 5.

The rear wall has an upper portion in the form of two upwardly and forwardly inclined tabs 27 which are bent to this angle from a point below the upper edge 28 of the rear wall 22.

Bent rearwardly from the side edges of the front wall are two side walls 30 which are each formed with a strengthening rib 31 and with a bearing portion 32, as well as wings 33 extending parallel to the axis of the bearings 32.

Figure 6:
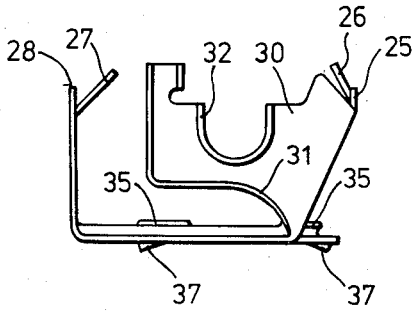
FIG. 6 is an elevation from the other side from that shown in FIGS. 1 to 4.
Figure 7:
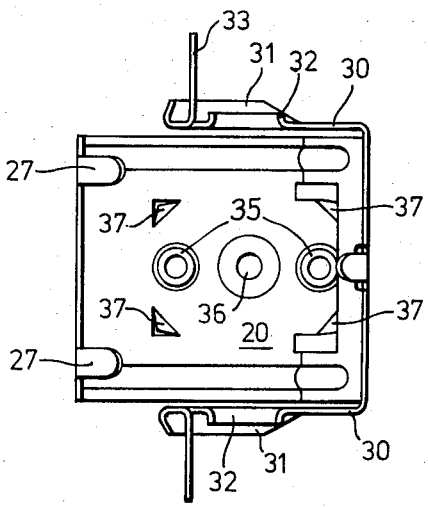
FIG. 7 is a top plan view of the tape roll support.

As can be seen in particular from FIG. 7, the base 20 is formed with two bosses 35, each provided with a central aperture for the passage of the upright cords of the ladder tape or cord, and with a central aperture 36 for the lift cord of the blind. Downturned portions 37 (FIGS. 6 and 7) are provided in the base also.

Figure 2:
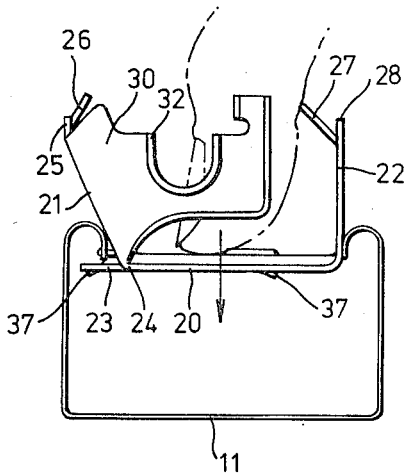

As can be seen from FIGS. 1 to 4, in order to install the tape roll support 18 in the headrail, the support is tilted so that the forwardly extending portion 23 of the base can be inserted under the tip 16 of the rim 14 of the front flange 12 of the headrail, and is then moved to the upright position illustrated in FIG. 2.

Figure 3:
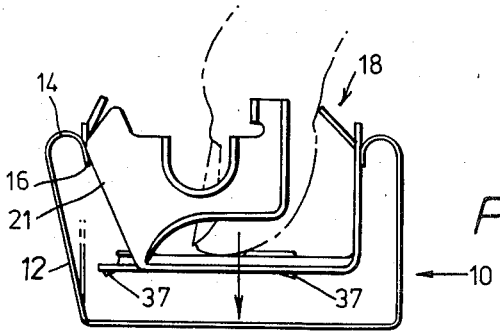

Thereafter simple downward pressure for example, with the thumb, shown in phantom in FIGS. 2 and 3, causes the rim 14 to ride along the inclined front wall 21 and thereby flexes the front flange 12 forwardly (see FIG. 3). This continues until the tip 16 is located in the position in which it is above the top edge of the part 25 whereupon the front flange 12 can start to spring back, so that the tip 16 engages the inclined tab 26. By this time the top edge 28 of the back wall 22 will be below the tip 17 of the rim 15 of the back flanges 13 of the headrail, so that the tape roll support can move to the rear (to the right in FIGS. 1 to 4) until the rear wall 22 engages the rear flange 13.

Figure 4:
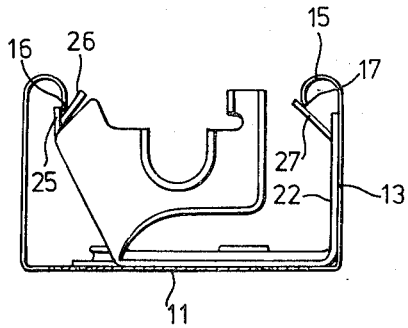

It will be seen from FIG. 4 that when this has happened, the base 20 engages the upper surface of the lower web 11, the tip 17 of the rim 15 of the rear flange 13 engages the inclined tab 27 and the tip 16 engages the rearwardly inclined tab 26. The projections 37 then engage in corresponding register openings 40 formed in the lower web 11.

The height of the projections 37 at the most equals the minimum thickness of the headrail web 11. This makes them almost invisible and the neat appearance on the headrail bottom is maintained. In the mounted position, due to the selected dimensions of the tape roll support with regard to the headrail dimensions, the rims 14 and 15 exert an inwardly directed clamping force on the inclined upper portions 26 and 27 which in combination with the fitting of the projections 37 in the register openings 40, give a solid and rattle-free fit for the support.

It will be appreciated that the insertion of the support roll in the headrail is greatly facilitated by having the inclined front wall 21 which is capable of flexing the front flange 12 outwardly during the insertion.

As mentioned, the terms "front" and "rear" wall and "front" and "rear" flanges have been used for convenience. Quite clearly the support roll could be inserted the other way around from that shown in the drawings, that is to say, so that the inclined wall 21 is to the right in FIGS. 1 to 4.

I claim:

1. A tape roll support for fitting in a venetian blind headrail, which is of channel-shaped cross-section, formed of a lower web and front and rear flanges, and having an inturned rim at the upper free edges of the front and rear flanges, said tape roll support comprising, in combination:

(a) a base engageable with the upper surfaces of the lower web of the headrail;

(b) an inclined front wall extending upwardly and forwardly from said base;

(c) a rear wall extending upwardly from said base;

(d) an upper portion at the top of said front wall inclined upwardly and rearwardly and engageable by the inturned rim at the upper free edge of the front flange, when the tape roll support is fully engaged in said headrail;

(e) an upper portion at the top of said rear wall inclined upwardly and forwardly and engageable by the inturned rim at the upper free edge of the rear flange, when the tape roll support is fully engaged in said headrail; and (f) side walls connected to said base between which the tape roll is rotatably mountable on a tilt rod.

2. A tape roll support as claimed in claim 1, wherein the base further comprises downwardly extending projections to cooperate with register openings in the lower web of the headrail.

3. A venetian blind comprising a headrail, which is of channel-shaped cross-section, formed of a lower web and front and rear flanges and having an inturned rim at the upper free edges of the front and rear flanges, a tilt mechanism carrying a tilt rod extending longitudinally of the headrail and at least two tape roll supports mounted in said headrail, said tape roll supports each comprising, in combination:

(a) a base engaged with the upper surface of the lower web of the headrail;

(b) an inclined front wall extending upwardly and forwardly from said base;

(c) a rear wall extending upwardly from said base;

(d) an upper portion at the top of said front wall inclined upwardly and rearwardly and engaged by the inturned rim at the upper free edge of the front flange;

(e) an upper portion at the top of said rear wall inclined upwardly and forwardly and engaged by the inturned rim at the upper free edge of the rear flange; and (f) side walls connected to said base between which the tape roll is rotatably mounted on said tilt rod; the position, the mutual distance and the inclination of the inclined upper portion of the front and back wall with respect to the mutual distance of the contacting rim portion of the headrail being selected so that, at the cross-sectional contact line, the mutual distance between the inclined upper portions is slightly larger than the mutual distance between the relevant rim portions to produce a clamping force.

4. A venetian blind as claimed in claim 3, wherein the base further comprises downwardly extending projections, cooperating with register openings in the headrail.

5. A venetian blind according to claim 3, wherein the projections are of a height so that they do not extend through the thickness of the material of the lower web of the headrail.

* * * * *

UNITED STATES PATENT AND TRADEMARK OFFICE

CERTIFICATE OF CORRECTION

PATENT NO. 4,237,957

DATED December 9, 1980

INVENTOR(S) Erich E. Hensel

It is certified that error appears in the above—identified patent and that said Letters Patent is hereby corrected as shown below:

On the title page, in item (73) after "Netherlands" insert -- Antilles --.

Column 2, line 4, "be" should read -- by --.

Column 3, line 6, "flanges" should read -- flange--.

Signed and Sealed this

*Twenty-seventh* Day of *April 1982*

[SEAL]

*Attest:*

GERALD J. MOSSINGHOFF

*Attesting Officer*

*Commissioner of Patents and Trademarks*